US008932152B2

(12) United States Patent
Okabe

(10) Patent No.: US 8,932,152 B2
(45) Date of Patent: Jan. 13, 2015

(54) GOLF BALL

(71) Applicant: Dunlop Sports Co. Ltd., Kobe-shi, Hyogo (JP)

(72) Inventor: Satoko Okabe, Kobe (JP)

(73) Assignee: Dunlop Sports Co. Ltd., Kobe-shi (JP)

( * ) Notice: Subject to any disclaimer, the term of this patent is extended or adjusted under 35 U.S.C. 154(b) by 162 days.

(21) Appl. No.: 13/645,136

(22) Filed: Oct. 4, 2012

(65) Prior Publication Data

US 2013/0090188 A1 Apr. 11, 2013

(30) Foreign Application Priority Data

Oct. 6, 2011 (JP) ..... 2011-222280

(51) Int. Cl.

*A63B 37/04* (2006.01)
*A63B 37/06* (2006.01)
*A63B 37/00* (2006.01)

(52) U.S. Cl.

CPC ..... *A63B 37/0075* (2013.01); *A63B 37/0076* (2013.01); *A63B 37/0031* (2013.01); *A63B 37/0036* (2013.01); *A63B 37/0062* (2013.01); *A63B 37/0064* (2013.01); *A63B 37/0065* (2013.01); *A63B 37/0069* (2013.01); *A63B 37/0003* (2013.01); *A63B 37/0051* (2013.01); *A63B 37/0059* (2013.01); *A63B 37/0058* (2013.01)

USPC ..... 473/371; 473/376; 473/377; 525/89; 525/71

(58) Field of Classification Search

USPC ..... 473/370–374, 376, 377

See application file for complete search history.

(56) References Cited

U.S. PATENT DOCUMENTS

| | | | | |
|---|---|---|---|---|
| 5,743,816 | A * | 4/1998 | Ohsumi et al. | 473/376 |
| 6,271,296 | B1 * | 8/2001 | Nakamura et al. | 524/423 |
| 6,579,939 | B2 * | 6/2003 | Ichikawa et al. | 525/89 |
| 6,605,009 | B1 | 8/2003 | Nakamura et al. | |
| 6,653,402 | B2 * | 11/2003 | Ichikawa et al. | 525/71 |
| 7,091,269 | B2 * | 8/2006 | Takesue et al. | 524/322 |
| 8,137,753 | B2 * | 3/2012 | Tarao et al. | 427/316 |
| 2001/0018374 | A1 * | 8/2001 | Ichikawa et al. | 473/367 |
| 2002/0037778 | A1 * | 3/2002 | Nakamura et al. | 473/377 |
| 2003/0083435 | A1 * | 5/2003 | Ichikawa et al. | 525/89 |

(Continued)

FOREIGN PATENT DOCUMENTS

| | | |
|---|---|---|
| JP | 06-504308 A | 5/1994 |
| JP | 2000-229133 A | 8/2000 |

(Continued)

*Primary Examiner* — Gene Kim
*Assistant Examiner* — John E Simms, Jr.
(74) *Attorney, Agent, or Firm* — Birch, Stewart, Kolasch & Birch, LLP

(57) ABSTRACT

A center of a golf ball is formed from a composition having a flexural modulus from 150-450 MPa, a maximum loss factor (tan δ) between −20 and 0° C. of 0.08 or less, a rebound resilience of 55% or more, and a slab hardness ranging from 40-60 in Shore D hardness. The center composition includes, as a resin component, 30 to 70 mass % of (A) a modified polyester elastomer having a Shore A hardness of 95 or less; 70-30 mass % of (B) a binary ionomer resin having a Shore D hardness of 65 or more, a flexural modulus of 300 MPa or more, and a melt flow rate (190° C., 2.16 kg) of 1.0 g/10 min or more; and 0-50 mass % of (C) a thermoplastic resin other than (A) and (B) components (provided that a total content of (A), (B), and (C) components is 100 mass %).

16 Claims, 1 Drawing Sheet

(56) References Cited

U.S. PATENT DOCUMENTS

| | | | | |
|---|---|---|---|---|
| 2004/0019138 | A1* | 1/2004 | Voorheis et al. | 524/100 |
| 2008/0305891 | A1* | 12/2008 | Isogawa | 473/374 |

FOREIGN PATENT DOCUMENTS

| | | | |
|---|---|---|---|
| JP | 2008-301985 | A | 12/2008 |
| WO | WO 92/12206 | A1 | 7/1992 |

* cited by examiner

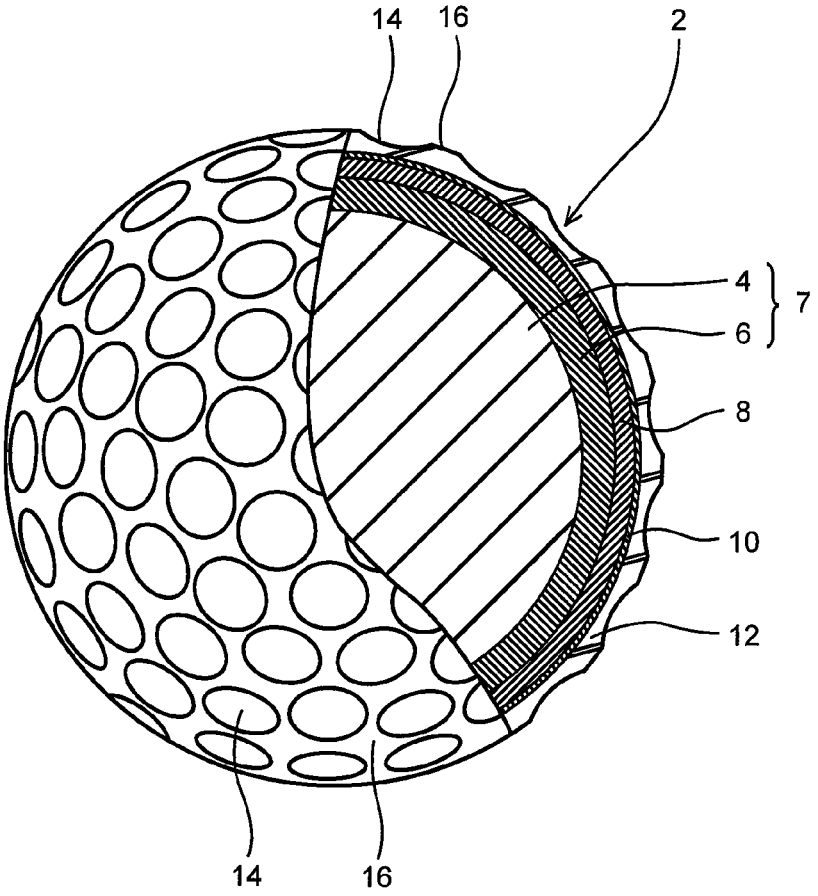
14
16
2
4
6
7
8
10
12
14
16

GOLF BALL

FIELD OF THE INVENTION

The present invention relates to a golf ball comprising a center, a cover and at least one intermediate layer disposed between the center and the cover, more particularly to a golf ball comprising a center formed from a resin composition.

DESCRIPTION OF THE RELATED ART

Golf balls comprising a center, a cover, and at least one intermediate layer disposed between the center and the cover are known. The intermediate layer is also referred to as "inner cover layer", "outer core layer" or "envelope layer" based on the golf ball construction. The center is, generally, formed from a rubber composition having a high resilience; however, in recent years, the center formed from a resin composition has been studied.

For example, Japanese Patent Publication No. 2008-301985 A discloses a golf ball comprising a core and a cover disposed outside the core, the core is composed of a center and an intermediate layer disposed outside the center, wherein the base polymer of the center includes a thermoplastic elastomer as a primary component. Examples of the primary component of the base polymer of the center include styrene block-containing thermoplastic elastomers, thermoplastic polyurethane elastomers, thermoplastic polyester elastomers and thermoplastic polyamide elastomers.

Japanese Patent Publication No. 2000-229133 A discloses a solid golf ball comprising a solid core and a cover covering the solid core, wherein the solid core has a multilayer construction which includes a center core and an outer core of at least one layer covering the center core, and wherein the center core is formed primarily of a resin and has a diameter from 3 mm to less than 15 mm, at least one layer of the outer core is formed of a rubber composition based on polybutadiene, and the center core has a surface hardness which is higher than the hardness of an innermost layer of the outer core.

Japanese Patent Publication No. H06-504308 T discloses a three-piece golf ball comprising a center formed of a composition containing a) from 65 to 90 weight % of a thermoplastic polymer selected from copolyetheramides and copolyetheresters; b) from 1 to 10 weight % of an epoxy-containing compound; and the remainder, to total 100 weight % of an acid-containing ethylene copolymer ionomer.

SUMMARY OF THE INVENTION

As described above, the center formed from a resin composition has been studied; however, the performance of the golf balls comprising the center formed from the resin composition is not always sufficient, and the performance is required to be further improved. The present invention has been achieved in view of the above circumstances. An object of the present invention is to provide a golf ball with an excellent resilience and having a high spin rate on approach shots.

The present invention, which has solved the above problem, provides a golf ball comprising a center, a cover and at least one intermediate layer disposed between the center and the cover, wherein the center is formed from a center composition having a flexural modulus ranging from 150 MPa to 450 MPa, a maximum loss factor (tan δ) between −20° C. and 0° C. of 0.08 or less, a rebound resilience of 55% or more, and a slab hardness ranging from 40 to 60 in Shore D hardness, and the center composition comprises, as a resin component, 30 mass % to 70 mass % of (A) a modified polyester elastomer having a Shore A hardness of 95 or less; 70 mass % to 30 mass % of (B) a binary ionomer resin having a Shore D hardness of 65 or more, a flexural modulus of 300 MPa or more, and a melt flow rate (190° C., 2.16 kg) of 1.0 g/10 min or more; and 0 mass % to 50 mass % of (C) a thermoplastic resin other than (A) component and (B) component (provided that a total content of (A) component, (B) component, and (C) component is 100 mass %).

The center of the golf ball of the present invention is formed from the center composition including (A) the modified polyester elastomer and (B) the binary ionomer resin. (A) The modified polyester elastomer has high compatibility with (B) the binary ionomer resin and has an action of softening the obtained center composition. The obtained center composition has a high resilience and can strike a balance between a soft shot feeling and resilience.

(A) The modified polyester elastomer is preferably obtained by a reaction between 0.01 mass % to 30 mass % of (a-3) an unsaturated carboxylic acid or a derivative thereof and 100 mass % of (a-2) a polyester elastomer containing a polyalkylene glycol component in a content ranging from 5 mass % to 90 mass % in a presence of (a-1) a radical generator.

(B) The binary ionomer resin contributes to an improvement of resilience of the obtained center. A content of an acid component in (B) the binary ionomer resin is preferably 15 mass % or more (C) The thermoplastic resin component has an action of softening the obtained center. (C) The thermoplastic resin component is preferably at least one member selected from the group consisting of polyurethane, polyolefin, polyester, polyimide, polystyrene, polycarbonate, polyacetal, modified poly(phenyleneether), polyimide, polysulfone, polyethersulfone, poly(phenylenesulfide), polyarylate, polyamideimide, polyetherimide, polyetheretherketone, polyetherketone, polytetrafluororoethylene, polyaminobismaleimide, polybisamidetriazole, an acrylonitrile-butadiene-styrene copolymer, an acrylonitrile-styrene copolymer, and an acrylonitrile-EPDM-styrene copolymer.

The center composition preferably contains at least one filler selected from the group consisting of gold, tungsten, lead, copper, iron, cast iron, pig iron, zinc, titanium, aluminum, zirconium, aluminum oxide, bismuth oxide, cerium oxide, copper oxide, tin oxide, titanium oxide, yttrium oxide, zinc oxide, silica, barium sulfate, calcium carbonate, talc, montmorillonite, and mica in an amount ranging from 1 part to 40 parts by mass with respect to 100 parts by mass of the resin component.

According to the present invention, a golf ball with an excellent resilience and having a high spin rate on approach shots is obtained.

BRIEF DESCRIPTION OF THE DRAWINGS

FIG. 1 is a schematic cross sectional view illustrating an embodiment of the golf ball of the present invention.

DESCRIPTION OF THE PREFERRED EMBODIMENT

The present invention provides a golf ball comprising a center, a cover and at least one intermediate layer disposed between the center and the cover, wherein the center is formed from a center composition having a flexural modulus ranging from 150 MPa to 450 MPa, a maximum loss factor (tan δ) between −20° C. and 0° C. of 0.08 or less, a rebound resilience of 55% or more, and a slab hardness ranging from 40 to 60 in Shore D hardness, and the center composition comprises, as a resin component, 30 mass % to 70 mass % of (A) a modified polyester elastomer having a Shore A hardness of 95 or less; 70 mass % to 30 mass % of (B) a binary ionomer resin having a Shore D hardness of 65 or more, a flexural modulus of 300 MPa or more, and a melt flow rate (190° C., 2.16 kg) of 1.0 g/10 min or more; and 0 mass % to 50 mass % of (C) a thermoplastic resin other than (A) component and (B) component (provided that a total content of (A) component, (B) component, and (C) component is 100 mass %).

(1) Golf Ball Construction

The golf ball of the present invention is not particularly limited, as long as the golf ball has a center, a cover and at least one intermediate layer disposed between the center and the cover. The golf ball of the present invention preferably has two intermediate layers. The intermediate layer is sometimes referred to as "inner cover layer", "outer core layer" or "envelope layer" based on the golf ball construction. If the golf ball of the present invention has two intermediate layers, the intermediate layer which directly covers the center is referred to as "envelope layer", and a spherical body composed of the center and the envelope layer is sometimes merely referred to as "spherical core".

In the followings, the preferable embodiments of the present invention will be described, referring to the drawings.

FIG. 1 is a partially cutaway view of a golf ball 2 according to an embodiment of the present invention. The golf ball 2 includes a center 4, an envelope layer 6 disposed outside the center 4, an intermediate layer 8 disposed outside the envelope layer 6 and a cover 12 disposed outside the intermediate layer 8. The spherical body composed of the center 4 and the envelope layer 6 may be referred to as "spherical core". In order to improve the adhesion between the intermediate layer 8 and the cover 12, a reinforcing layer 10 may be formed between the intermediate layer 8 and the cover 12. On the surface of the cover 12, a large number of dimples 14 are formed. Of the surface of the golf ball 2, a part other than the dimples 14 is a land 16. The golf ball 2 includes a paint layer and a mark layer on the external side of the cover 12, although these layers are not shown in the drawings.

The center generally has the spherical shape, but the center may be provided with a rib on the surface thereof so that the surface of the spherical center is evenly divided by the ribs. In one embodiment, the ribs are preferably formed on the surface of the spherical center in an integrated manner. The ribs are preferably formed along an equatorial line and meridians that evenly divide the surface of the spherical center, if the spherical center is assumed as the earth. For example, if the surface of the spherical center is evenly divided into 8, the ribs are formed along the equatorial line, any meridian as a standard, and meridians at the longitude 90 degrees east, longitude 90 degrees west, and the longitude 180 degrees east (west), assuming that the meridian as the standard is at longitude 0 degree. If the ribs are formed, the depressed portion divided by the ribs are preferably filled with a plurality of envelope layers or with a single-layered envelope layer that fills each of the depressed portions to make a molded body consisting of the center and the envelope layer in the spherical shape.

The central hardness of the center is preferably 30 or more, more preferably 35 or more, and even more preferably 40 or more in JIS-C hardness. If the central hardness is 30 or more in JIS-C hardness, the resilience improves. In light of suppression of the spin upon driver shots, the central hardness is preferably 85 or less, more preferably 83 or less, and even more preferably 80 or less. The central hardness is measured by pressing a JIS-C type hardness scale at a central point of a cut plane of the hemisphere obtained by cutting the center. For the measurement, a type P1 auto loading durometer manufactured by Kobunshi Keiki Co., Ltd., provided with a JIS-C type spring hardness tester is used.

The surface hardness of the center is preferably 60 or more, more preferably 63 or more, and even more preferably 65 or more in JIS-C hardness. If the surface hardness is 60 or more, the resilience performance improves. In light of the shot feeling, the surface hardness is preferably 95 or less, and more preferably 90 or less. The surface hardness is measured by pressing the JIS-C type hardness scale on the surface of the center. For the measurement, a type P1 auto loading durometer manufactured by Kobunshi Keiki Co., Ltd., provided with a JIS-C type spring hardness tester is used.

The center contributes to the resilience performance of the golf ball. The center preferably has a diameter of 5.0 mm or more, more preferably 10 mm or more, and even more preferably 15 mm or more. Using the center having a diameter of 5.0 mm or more enhances the resilience of the golf ball. In light of forming the envelope layer with a sufficient thickness, the diameter of the center is preferably 40 mm or less, and more preferably 35 mm or less.

When the center has a diameter from 5.0 mm to less than 30.0 mm, a compression deformation amount (shrinking deformation amount of the center along the compression direction) of the center when applying a load from an initial load of 98 N to a final load of 1275 N is preferably 0.8 mm or more, more preferably 1.0 mm or more, and even more preferably 1.2 mm or more. If the compression deformation amount is 0.8 mm or more, the shot feeling improves. The compression deformation amount is preferably 3.0 mm or less, more preferably 2.8 mm or less, and even more preferably 2.6 mm or less. If the compression deformation amount is 3.0 mm or less, the resilience improves.

When the center has a diameter from 30.0 mm to less than 41.0 mm, a compression deformation amount (shrinking deformation amount of the center along the compression direction) of the center when applying a load from an initial load of 98 N to a final load of 1275 N is preferably 2.0 mm or more, more preferably 2.3 mm or more, and even more preferably 2.6 mm or more. If the compression deformation amount is 2.0 mm or more, the shot feeling improves. The compression deformation amount is preferably 4.0 mm or less, more preferably 3.8 mm or less, and even more preferably 3.6 mm or less. If the compression deformation amount is 4.0 mm or less, the resilience improves.

Upon measurement of the compression deformation amount, the spherical body (center, core or golf ball) is placed on a hard plate made of metal. A cylinder made of metal gradually descends toward the spherical body. The spherical body intervened between the bottom face of the cylinder and the hard plate is deformed. A migration distance of the cylinder, starting from the state in which an initial load of 98 N is applied to the spherical body up to the state in which a final load of 1275 N is applied thereto is the compression deformation amount.

The center preferably has a density of 1.5 g/cm$^3$ or less, and more preferably 1.3 g g/cm$^3$ or less. If the center has a lower density, the golf ball has a high inertia moment. As a result, the backspin maintains, and the golf ball traveling a great distance is obtained. The center preferably has a density of 0.80 g/cm$^3$ or more, and more preferably 0.85 g/cm$^3$ or more.

The mass of the center is preferably 1.0 g or more, more preferably 1.2 g or more, and is preferably 40.0 g or less, more preferably 39.0 g or less.

The envelope layer preferably has a slab hardness of 40 or more, more preferably 42 or more, and even more preferably 45 or more in JIS-C hardness. If the envelope layer has a slab hardness of 40 or more in JIS-C hardness, the flight performance and shot feeling become better. Further, in light of the shot feeling and durability, the envelope layer preferably has a slab hardness of 90 or less, and more preferably 88 or less in JIS-C hardness. The slab hardness of the envelope layer may be measured using a type LA1 auto loading durometer manufactured by Kobunshi Keiki Co., Ltd., provided with a JIS-C type spring hardness tester. For the measurement, a slab molded from an envelope layer composition with a thickness of about 2 mm is used. The slab which has been stored at a temperature of 23° C. for two weeks is used for the measurement. When the measurement is carried out, three pieces of the slab are stacked.

In light of the flight performance, the envelope layer preferably has a thickness of 2.0 mm or more, more preferably 3.5 mm or more, and even more preferably 5.0 mm or more. In light of the shot feeling, the envelope layer preferably has a thickness of 25 mm or less, more preferably 23 mm or less, and even more preferably 21 mm or less.

The envelope layer preferably has a density of 0.8 g/cm$^3$ or more, more preferably 0.85 g/cm$^3$ or more, and the envelope layer preferably has a density of 1.5 g/cm$^3$ or less, more preferably 1.3 g/cm$^3$ or less. If the density of the envelope layer falls within the above range, the desired spin performance is obtained.

The surface hardness of the spherical core composed of the center and the envelope layer is preferably 40 or more, more preferably 45 or more, and even more preferably 50 or more in JIS-C hardness. If the surface hardness is 40 or more, the resilience performance is improved. In light of the shot feeling, the surface of the spherical core is preferably 95 or less, and more preferably 90 or less in JIS-C hardness. The surface hardness is measured by pressing a JIS-C type hardness scale at the surface of the spherical core. For the measurement, a type P1 auto loading durometer manufactured by Kobunshi Keiki Co., Ltd., provided with a JIS-C type spring hardness tester is used.

The spherical core preferably has a diameter of 7 mm or more, more preferably 10 mm or more, and even more preferably 15 mm or more. Using the spherical core having a diameter of 7 mm or more enhances the resilience of the golf ball. In light of forming the intermediate layer and cover with a sufficient thickness, the diameter of the spherical core is preferably 41.0 mm or less, and more preferably 40.0 mm or less.

When the spherical core has a diameter from 7.0 mm to less than 30.0 mm, a compression deformation amount (shrinking deformation amount of the core along the compression direction) of the spherical core when applying a load from an initial load of 98 N to a final load of 1275 N is preferably 0.8 mm or more, more preferably 1.0 mm or more, even more preferably 1.2 mm or more. If the compression deformation amount is 0.8 mm or more, the shot feeling improves. The compression deformation amount is preferably 3.0 mm or less, and more preferably 2.8 mm or less. If the compression deformation amount is 3.0 mm or less, the resilience improves.

When the spherical core has a diameter from 30.0 mm to 41.0 mm, a compression deformation amount (shrinking deformation amount of the core along the compression direction) of the spherical core when applying a load from an initial load of 98 N to a final load of 1275 N is preferably 2.0 mm or more, more preferably 2.2 mm or more, even more preferably 2.4 mm or more. If the compression deformation amount is 2.0 mm or more, the shot feeling improves. The compression deformation amount is preferably 4.0 mm or less, more preferably 3.8 mm or less, and even more preferably 3.6 mm or less. If the compression deformation amount is 4.0 mm or less, the resilience improves.

In light of the resilience performance, the intermediate layer preferably has a slab hardness of 40 or more, and more preferably 45 or more in Shore D hardness. In light of the shot feeling, the intermediate layer preferably has a slab hardness of 70 or less, more preferably 68 or less, and even more preferably 66 or less in Shore D hardness. The slab hardness of the intermediate layer may be measured in accordance with a standard of "ASTM-D 2240-68" by using a type LA1 auto loading durometer manufactured by Kobunshi Keiki Co., Ltd., provided with a Shore D type spring hardness tester. For the measurement, a slab molded from an intermediate layer composition with a thickness of about 2 mm is used. The slab which has been stored at a temperature of 23° C. for two weeks is used for the measurement. When the measurement is carried out, three pieces of the slab are stacked.

The intermediate layer preferably has a thickness of 0.5 mm or more, more preferably 0.6 mm or more, and even more preferably 0.7 mm or more. If the thickness of the intermediate layer is 0.5 mm or more, the durability becomes better. The intermediate layer preferably has a thickness of 1.7 mm or less, more preferably 1.5 mm or less, and even more preferably 1.2 mm or less. If the thickness of the intermediate layer is 1.7 mm or less, the shot feeling becomes better.

The intermediate layer preferably has a density of 0.85 g/cm$^3$ or more, more preferably 0.90 g/cm$^3$ or more, and the intermediate layer preferably has a density of 2.0 g/cm$^3$ or less, more preferably 1.8 g/cm$^3$ or less. If the density of the intermediate layer falls within the above range, the inertia moment becomes higher, and the spin performance is enhanced.

The golf ball of the present invention may have a reinforcing layer between the intermediate layer and the cover. The reinforcing layer adheres firmly to the intermediate layer as well as to the cover. The reinforcing layer suppresses delamination of the cover from the intermediate layer. In particular, when the golf ball with a thin cover is hit with an edge of a clubface, a wrinkle easily generates. The reinforcing layer suppresses the generation of the wrinkle.

In light of suppressing the wrinkle, the reinforcing layer preferably has a thickness of 3 μm or greater, and more preferably 5 μm or greater. In order to facilitate the formation of the reinforcing layer, the reinforcing layer preferably has a thickness of 30 μm or less, more preferably 20 μm or less, and even more preferably 10 μm or less. The thickness is measured by observing a cross section of the golf ball with a microscope. When the intermediate layer has concavities and convexities on its surface by surface roughening, the thickness of the reinforcing layer is measured at the top of the convex part.

In light of suppressing the wrinkle, the reinforcing layer preferably has a pencil hardness of 4B or harder, and more preferably B or harder. In light of reduced loss of the power transmission from the cover to the intermediate layer upon a hit of the golf ball, the reinforcing layer preferably has a pencil hardness of 3H or softer. The pencil hardness is measured according to the standard of "JIS K5400".

The slab hardness of the cover of the golf ball of the present invention is preferably 20 or more, more preferably 22 or more, and even more preferably 24 or more in Shore D hardness. If the slab hardness of the cover is 20 or more in Shore D hardness, the abrasion resistance of the cover improves. The slab hardness of the cover is preferably 70 or less, more preferably 68 or less, and even more preferably 65 or less in Shore D hardness. If the slab hardness of the cover is 70 or less in Shore D hardness, the spin rate on approach shots increases, and the controllability is improved. The slab hardness of the cover is measured by the same method as that for hardness of the intermediate layer.

The cover preferably has a thickness of 0.3 mm or more, more preferably 0.4 mm or more, and even more preferably 0.5 mm or more. If the cover is too thin, it becomes difficult to mold the cover. The cover preferably has a thickness of 2.5 mm or less, more preferably 2.2 mm or less, and even more preferably 2.0 mm or less. If the cover is too thick, the resilience may deteriorate.

The mass of the golf ball of the present invention ranges from 40 g to 50 g. In light of obtaining great inertia, the mass is preferably 44 g or more, more preferably 45.00 g or more. In light of satisfying a regulation of USGA, the mass is preferably 45.93 g or less.

The golf ball of the present invention has a diameter ranging from 40 mm to 50 mm. In light of satisfying a regulation of US Golf Association (USGA), the diameter is preferably 42.67 mm or more. In light of prevention of the resistance of air, the diameter is preferably 44 mm or less, and more preferably 42.80 mm or less.

When the golf ball has a diameter ranging from 40 mm to 45 mm, the compression deformation amount (shrinking deformation amount of the golf ball along the compression direction) of the golf ball of the present invention when applying a load from an initial load of 98 N to a final load of 1275 N is preferably 2.0 mm or greater, more preferably 2.2 mm or greater, even more preferably 2.4 mm or greater. If the compression deformation amount is 2.0 mm or more, the golf ball with a good shot feeling can be obtained. The compression deformation amount is preferably 5.0 mm or less, more preferably 4.8 mm or less, and even more preferably 4.6 mm or less. If the compression deformation amount is 5.0 mm or less, the resilience improves.

The total number of the dimples formed on the surface of the golf ball of the present invention is preferably 200 or more and 500 or less. If the total number of the dimples is less than 200, the dimple effect is hardly obtained. On the other hand, if the total number of the dimples exceeds 500, the dimple effect is hardly obtained because the size of the respective dimples is small. The shape (shape in a plan view) of dimples includes, for example, without limitation, a circle, polygonal shapes such as roughly triangular shape, roughly quadrangular shape, roughly pentagonal shape, and roughly hexagonal shape, another irregular shape. The shape of the dimples is employed solely or in combination at least two of them.

(2) Center Composition

The center of the golf ball of the present invention is formed from a center composition containing (A) a modified polyester elastomer having a Shore A hardness of 95 or less; (B) a binary ionomer resin having a Shore D hardness of 65 or more, a flexural modulus of 300 MPa or more, and a melt flow rate (190° C., 2.16 kg) of 1.0 g/10 min or more; and, if desired, (C) a thermoplastic resin other than (A) component and (B) component.

First, (A) the modified polyester elastomer having a Shore A hardness of 95 or less will be explained. (A) The modified polyester elastomer used in the present invention is preferably obtained by carrying out a reaction between (a-3) an unsaturated carboxylic acid or a derivative thereof and (a-2) a polyester elastomer in a presence of (a-1) a radical generator. In the modification reaction, it is considered that the graft reaction of (a-3) the unsaturated carboxylic acid or a derivative thereof to (a-2) the polyester elastomer mainly occurs with some other reactions such as a reaction where the unsaturated carboxylic acid or a derivative is added to the terminal of the polyester elastomer, an ester exchange reaction, and decomposition. (A) The modified polyester elastomer preferably has (a-3) the unsaturated carboxylic acid or a derivative thereof which are grafted in a content ranging from 0.03 mass % to 20 mass %. The grafting content more preferably ranges from 0.06 mass % to 4 mass %, even more preferably 0.08 mass % to 1.5 mass %. If the grafting content falls within the above range, the dispersibility into (B) the binary ionomer resin improves and the durability of the obtained golf ball becomes better.

Although many polyester elastomers are known as (a-2) the polyester elastomer, preferred is a polyester elastomer composed of an aromatic polyester component as a hard segment and a polyalkylene glycol or aliphatic polyester component as a soft segment. In the present invention, particularly preferred is a polyester polyether block copolymer having an aromatic polyester component as the hard segment and a polyalkylene glycol component as the soft segment. The content of the polyalkylene glycol component is preferably in a range from 5 mass % to 90 mass %, more preferably 30 mass % to 80 mass %, and even more preferably 55 mass % to 80 mass % in the block copolymer produced. In general, it tends to be difficult to produce the polymer having a high content of the polyalkylene glycol component by a condensation polymerization. Further, it is also difficult that the thermoplastic resin consisting of the polymer having a high content of the polyalkylene glycol as a material and the ionomer resin exhibits an appropriate hardness and a high rebound resilience. On the contrary, if the content of the polyalkylene glycol component is low, the elastic property becomes low. Thus, it is difficult that the center composition consisting of the polymer having a low content of the polyalkylene glycol as a material and the ionomer resin exhibits an appropriate softness and a high rebound resilience. Further, the dispersibility into (B) the binary ionomer resin becomes low.

The polyester polyether block copolymer can be produced by preparing an oligomer by esterification or an ester exchange reaction in a conventional method, using an aliphatic diol or alicyclic diol each having 2 to 12 carbon atoms, and an aromatic dicarboxylic acid, aliphatic dicarboxylic acid or an alkyl ester thereof as a component forming the hard segment; and a polyalkylene glycol having a weight average molecular weight from 400 to 6,000 as a component forming the soft segment; and condensation polymerizing the obtained oligomer. Examples of the aliphatic diol or alicyclic diol each having 2 to 12 carbon atoms include ethylene glycol, propylene glycol, trimethylene glycol, 1,4-butane diol, 1,4-cyclohexanediol, and 1,4-cyclohexanedimethanol. Among them, preferred is 1,4-butane diol or ethylene glycol, particularly preferred is 1,4-butane diol. These diols may be used in combination of two or more, if desired.

As the aromatic dicarboxylic acid, those which are generally used as a raw material for polyester elastomers can be used. Examples thereof include terephthalic acid, isophthalic acid, phthalic acid, and 2,6-naphthalene dicarboxylic acid. The aromatic dicarboxylic acid preferably includes terephthalic acid or 2,6-naphthalene dicarboxylic acid, more preferably terephthalic acid. These aromatic dicarboxylic acids may be used in combination of two or more. Examples of the alkyl esters of the aromatic dicarboxylic acids include dimethyl esters and diethyl esters of the aromatic dicarboxylic acids. Preferred is dimethyl terephthalate or 2,6-dimethylnaphthalate. The alicyclic dicarboxylic acid preferably includes cyclohexane dicarboxylic acid. The alkyl ester thereof preferably includes a dimethyl ester or a diethyl ester. In addition to the above components, a small amount of a tri-functional alcohol, tricarboxylic acid, or esters thereof may be copolymerized, if desired. Also, an aliphatic dicarboxylic acid such as adipic acid or its dialkyl ester may be used as a comonomer.

The polyalkylene glycol having a weight-average molecular weight ranging from 400 to 6,000 is preferably used. The weight-average molecular weight is more preferably 500 to 4,000, even more preferably 600 to 3,000. In general, if the polyalkylene glycol having a low weight-average molecular weight is used, it becomes difficult that the resultant polyester elastomer exhibit the elastic property. On the contrary, the polyalkylene glycol having an excessively high weight-average molecular weight tends to cause the phase separation of the reaction system, and the properties of the resultant polyester elastomer tend to be lowered. Examples of the polyalkylene glycol include polyethylene glycol, poly(1,2- and 1,3-propylene ether) glycol, polytetramethylene glycol, and polyhexamethylene glycol. The commercial products of polyester elastomers include "Primalloy" (Mitsubishi Chemical Corporation), "Pelprene" (Toyobo Co., Ltd.), and "Hytrel" (Du Pont-Toray Co., Ltd.), etc.

(a-2) The polyester elastomer used in the present invention preferably has polybutylene terephthalate as the hard segment and polytetramethylene glycol as the soft segment.

Examples of (a-3) the unsaturated carboxylic acid used for the modification of the polyester elastomer include unsaturated carboxylic acids such as acrylic acid, maleic acid, fumaric acid, tetrahydrophtalic acid, itaconic acid, citraconic acid, crotonic acid, and isocrotonic acid, which may have an alkyl group, a halogen atom or the like as a substituent. Examples of the derivative thereof include an ester and an anhydride thereof. The anhydride having an unsaturated bond in the side chain can be also used. Examples include unsaturated carboxylic anhydrides such as (2-octene-1-yl)succinic anhydride, (2-dodecene-1-yl)succinic anhydride, (2-octadecene-1-yl)succinic anhydride, maleic anhydride, 2,3-dimethylmaleic anhydride, bromomaleic anhydride, dichloromaleic anhydride, citraconic anhydride, itaconic anhydride, 1-butene-3,4-dicarboxylic acid anhydride, 1-cyclopentene-1,2-dicarboxylic acid anhydride, 1,2,3,6-tetrahydrophthalic anhydride, 3,4,5,6-tetrahydrophthalic anhydride, exo-3,6-epoxy-1,2,3,6-tetrahydrophthalic anhydride, 5-norbornene-2,3-dicarboxylic anhydride, methyl-5-norbornene-2,3-dicarboxylic anhydride, endo-bicyclo[2.2.2]oct-5-ene-2,3-dicarboxylic anhydride, and bicyclo[2.2.2]oct-7-ene-2,3,5,6-tetracarboxylic anhydride; and unsaturated carboxylic acid esters such as methyl (meth)acrylate, ethyl (meth)acrylate, propyl (meth)acrylate, butyl (meth)acrylate, hexyl (meth) acrylate, octyl (meth)acrylate, 2-ethylhexyl (meth)acrylate, lauryl (meth)acrylate, stearyl (meth)acrylate, glycidyl (meth) acrylate, dimethyl maleate, 2-ethylhexyl maleate, 2-hydroxyethyl methacrylate. Among them, preferred is an anhydride of the unsaturated carboxylic acid, particularly preferred is an anhydride of maleic acid. These compounds having unsaturated bonds are suitably selected according to the type of the polyester elastomer to be modified and the modification conditions and may be used in combination of two or more.

As (a-1) the radical generator, various compounds can be used. Examples of the radical generator include organic or inorganic peroxides such as t-butyl hydroperoxide, cumene hydroperoxide, 2,5-dimethylhexane 2,5-dihydroperoxide, 2,5-dimethyl-2,5-bis(t-butyloxy)hexane, 3,5,5-trimethylhexanoyl peroxide, t-butyl peroxybenzoate, benzoyl peroxide, dicumyl peroxide, 1,3-bis(t-butylperoxyisopropyl)benzene, dibutyl peroxide, methyl ethyl ketone peroxide, potassium peroxide, and hydrogen peroxide; azo compounds such as 2,2'-azobisisobutyronitrile, 2,2'-azobis(isobutylamide)dihalide, 2,2'-azobis[2-methyl-N-(2-hydroxyethyl)propionamide], and azodi-t-butane; and carbon radical generators such as dicumyl. The radical generators are suitably selected according to the type of the polyester elastomer to be modified, the type of the unsaturated carboxylic acid or derivative thereof and the modification conditions, and may be used in combination of two or more.

In the modification reaction, the blending ratio of (a-3) component preferably ranges from 0.01 mass % to 30 mass %, more preferably 0.05 mass % to 5 mass %, even more preferably 0.1 mass % to 2 mass %, most preferably 0.1 mass % to 1 mass % with respect to 100 mass % of (a-2) component. The blending ratio of (a-1) component preferably ranges from 0.001 mass % to 3 mass %, more preferably 0.005 mass % to 0.5 mass %, even more preferably 0.01 mass % to 0.2 mass %, most preferably 0.01 mass % to 0.1 mass % with respect to 100 mass % of (a-2) component. In most preferable modification, the blending ratio of (a-3) component ranges from 0.1 mass % to 1 mass % and the blending ratio of (a-1) component ranges from 0.01 mass % to 0.1 mass %, with respect to 100 mass % of (a-2) component.

In general, if the blending amount of (a-3) component is low, the modification degree becomes small, and thus the center composition obtained by blending the resultant polyester elastomer and the ionomer resin does not tend to exhibit a sufficient wear resistance. On the other hand, if the blending amount is excessive, the resultant polyester elastomer has a low viscosity when melt, and thus it is difficult to mold the center composition obtained by blending the resultant polyester elastomer with the ionomer resin. Further, if the blending amount of (a-1) component is too low, the modification does not occur sufficiently, and thus the sufficient wear resistance is hardly exhibited. On the contrary, if the blending amount is too much, the resultant polyester elastomer has a low viscosity when melt, and thus the moldability becomes worse.

The modification for producing the modified polyester elastomer using (a-1) component, (a-2) component, and (a-3) component is conducted by a known method such as a melt kneading method, solution method and suspended dispersion method. Conventionally, the melt kneading method is preferable. In case of the melt kneading method, (a-2) component, (a-3) component, and (a-1) component may be uniformly mixed at a predetermined blending ratio using a Henschel mixer, a ribbon blender, a V-shape blender or the like and then the resultant mixture may be melt-kneaded using a Banbury mixer, a kneader, a roll, or a single- or multi- (e.g. twin-) screw kneading extruder. If necessary, (a-3) component and (a-2) component may be solved in a solvent for the modification reaction. The melt kneading is preferably performed at the temperature ranging from 100° C. to 300° C., more preferably 120° C. to 280° C., even more preferably 150° C. to 250° C., so as to avoid the thermal degradation of the resins.

(A) The modified polyester elastomer used in the present invention preferably has a slab hardness of 95 or less, more preferably 93 or less, even more preferably 91 or less in Shore A hardness, and preferably has a slab hardness of 70 or more, more preferably 75 or more, even more preferably 80 or more in Shore A hardness. If the slab hardness of the modified polyester elastomer falls within the above range, the center composition tends to have a hardness in a desired range, and shows a good balance with the resilience. The slab hardness of the modified polyester elastomer means a hardness obtained by measuring the modified polyester elastomer formed in a sheet form, and can be measured by a later-described method.

Next, (B) the binary ionomer resin will be explained. The binary ionomer resin is one prepared by neutralizing at least a part of carboxyl groups in a binary copolymer composed of an olefin and an α,β-unsaturated carboxylic acid having 3 to 8 carbon atoms with a metal ion. The olefin preferably includes an olefin having 2 to 8 carbon atoms. Examples of the olefin include ethylene, propylene, butene, pentene, hexene, heptene, and octene. Among them, ethylene is more preferred. Examples of the α,β-unsaturated carboxylic acid are acrylic acid, methacrylic acid, fumaric acid, maleic acid and crotonic acid. Among these, acrylic acid and methacrylic acid are particularly preferred. Among them, as (B) the binary ionomer resin, preferred is a metal ion-neutralized product of the binary copolymer composed of ethylene-(meth)acrylic acid.

The content of the α,β-unsaturated carboxylic acid having 3 to 8 carbon atoms in (B) the binary ionomer resin is preferably 15 mass % or more, more preferably 16 mass % or more, even more preferably 17 mass % or more, and is preferably 30 mass % or less, more preferably 25 mass % or less. If the content of the α,β-unsaturated carboxylic acid is 15 mass % or more, the resilience and hardness become better, while if the acid content is 30 mass % or less, the balance among the resilience, moldability and hardness becomes better.

Examples of a metal (ion) used for neutralizing the binary copolymer include: monovalent metals (ions) such as sodium, potassium, lithium, or the like; divalent metals (ions) such as magnesium, calcium, zinc, barium, cadmium, or the like; trivalent metals (ions) such as aluminum or the like; and other metals (ions) such as tin, zirconium, or the like. Among these metals (ions), sodium, zinc and magnesium (ions) are preferably used because they provide excellent resilience, durability, or the like.

The degree of neutralization of the carboxyl groups contained in the binary ionomer resin is preferably 20 mole % or more, more preferably 30 mole % or more, and is preferably 90 mole % or less, more preferably 85 mole % or less. If the degree of neutralization is 20 mole % or more, the center has a better resilience and durability. If the degree of neutralization is 90 mole % or less, the fluidity of the center composition becomes better (resulting in good moldability). It is noted that the degree of neutralization of the carboxyl groups in the ionomer resin can be calculated by the following expression.

Degree of neutralization (mole %)=(the number of moles of carboxyl groups neutralized in the ionomer resin/the number of moles of all carboxyl groups contained in the ionomer resin)×100

Specific examples of the binary ionomer resin include trade name "Himilan (registered trademark) (e.g. Himilan 1605 (Na), Himilan 1706 (Zn), Himilan 1707 (Na), Himilan AM7329 (Zn), Himilan AM7311 (Mg))" commercially available from Du Pont-Mitsui Polychemicals Co., Ltd.

Further, examples include "Surlyn (registered trademark) (e.g. Surlyn 8945 (Na), Surlyn 9945 (Zn), Surlyn 8140 (Na), Surlyn 8150 (Na), Surlyn 9120 (Zn), Surlyn 9150 (Zn), Surlyn 6120 (Mg), Surlyn 7930 (Li), Surlyn 7940 (Li), Surlyn AD8546 (Li))" commercially available from E.I. du Pont de Nemours and Company.

Further, examples include "lotek (registered trademark) (e.g. lotek 8000 (Na), lotek 8030 (Na), lotek 7010 (Zn), lotek 7030 (Zn))" commercially available from ExxonMobil Chemical Corporation.

The binary ionomer resins may be used alone or as a mixture of at least two of them. It is noted that Na, Zn, Li, and Mg described in the parentheses after the trade names indicate metal types of neutralizing metal ions for the metal-neutralized copolymer.

The flexural modulus of (B) the binary ionomer resin is preferably 300 MPa or more, more preferably 310 MPa or more, and even more preferably 330 MPa or more, and is preferably 600 MPa or less, more preferably 550 MPa or less, and even more preferably 500 MPa or less. If the flexural modulus of (B) the binary ionomer resin is too low, the elastic modulus of the center becomes low, and the effects of increasing the launch angle and reducing the spin rate become small. On the other hand, if the flexural modulus of (B) the binary ionomer resin is too high, the elastic modulus of the center becomes excessively high, and the durability and the shot feeling of the golf ball tend to deteriorate.

The melt flow rate (190° C., 2.16 kg) of the binary ionomer resin is preferably 1.0 g/10 min or more, more preferably 1.5 g/10 min or more, and even more preferably 2.0 g/10 min or more, and is preferably 30 g/10 min or less, more preferably 25 g/10 min or less, and even more preferably 20 g/10 min or less. If the melt flow rate (190° C., 2.16 kg) of the binary ionomer resin is 1.0 g/10 min or more, the fluidity of the center composition becomes good. If the melt flow rate (190° C., 2.16 kg) of the binary ionomer resin is 30 g/10 min or less, the durability of the obtained golf ball becomes better.

The binary ionomer resin preferably has a slab hardness of 65 or more, more preferably 66 or more, even more preferably 67 or more, and preferably has a slab hardness of 80 or less, more preferably 75 or less, even more preferably 70 or less in Shore D hardness. If the slab hardness of the binary ionomer resin is 65 or more in Shore D hardness, the resilience becomes better. If the slab hardness of the binary ionomer resin is 80 or less in Shore D hardness, the center does not become excessively hard and the durability of the golf ball becomes better.

(C) Other Thermoplastic Resins than (A) Component and (B) Component

The center composition used in the present invention may further comprise other thermoplastic resins than (A) component and (B) component, in addition to (A) component and (B) component. Examples of (C) component include polyurethane, polyolefin, polyester, polyamide, polystyrene, polycarbonate, polyacetal, modified poly(phenyleneether), polyimide, polysulfone, polyethersulfone, poly(phenylenesulfide), polyarylate, polyamideimide, polyetherimide, polyetheretherketone, polyetherketone, polytetrafluororoethylene, polyaminobismaleimide, polybisamidetriazole, an acrylonitrile-butadiene-styrene copolymer, an acrylonitrile-styrene copolymer, an acrylonitrile-EPDM-styrene copolymer.

Specific examples of (C) component are a thermoplastic polyamide elastomer having a trade name "Pebax (registered trademark) (e.g. "Pebax 2533")" commercially available from Arkema Inc., a thermoplastic polyurethane elastomer having a trade name "Elastollan (registered trademark) (e.g. "Elastollan XNY85A")" commercially available from BASF Japan Ltd., a thermoplastic polyester elastomer having a trade name "Hytrel (registered trademark) (e.g. "Hytrel 3548" and "Hytrel 4047")" commercially available from Du Pont-Toray Co., Ltd., a thermoplastic styrene elastomer having a trade name "Rabalon (registered trademark) (e.g. "Rabalon T3221C")" commercially available from Mitsubishi Chemical Corporation, or the like.

In the present invention, the center composition contains, as a resin component, (A) the modified polyester elastomer in an amount of 30 mass % to 70 mass %, (B) the binary ionomer resin in an amount of 70 mass % to 30 mass %, and (C)

component in an amount of 0 mass % to 50 mass %, provided that a total content of (A) component, (B) component, and (C) component is 100 mass %. The contents of (A) component and (B) component preferably range from 35 mass % to 65 mass %, more preferably from 40 mass % to 60 mass %, respectively. If the contents of (A) component and (B) component fall within the above range, the center has an appropriate rigidity and the golf ball has the high launch angle and low spin rate. Therefore, the golf ball travels a great distance. In addition, the shot feeling is improved.

The content of (C) component in the center composition is preferably 0.1 mass % or more, more preferably 0.15 mass % or more, even more preferably 0.2 mass % or more, and is preferably 50 mass % or less, more preferably 45 mass % or less, even more preferably 40 mass % or less. If the content of (C) component falls within the above range, the center composition has a desired hardness without lowering the mechanical properties.

The center composition may further contain pigment components such as a white pigment (for example, titanium oxide) and a blue pigment; a mass adjusting agent; a dispersant; an antioxidant; an ultraviolet absorber; a light stabilizer; a fluorescent material or a fluorescent brightener or the like, as long as the performance of the golf ball of the present invention does not deteriorate.

Examples of the mass adjusting agent are metals such as gold, tungsten, molybdenum, lead, copper, iron, cast iron, pig iron, zinc, titanium, aluminum, zirconium; metal oxides such as aluminum oxide, bismuth oxide, cerium oxide, copper oxide, tin oxide, titanium oxide, yttrium oxide, zinc oxide, silica; barium sulfate; calcium carbonate; talc; montmorillonite; and mica. The mass adjusting agent may be used alone or in combination of two or more of them.

The blending amount of the mass adjusting agent is preferably 1 part by mass or more, more preferably 2 parts by mass or more, even more preferably 3 parts by mass or more, and is preferably 50 parts by mass or less, more preferably 47 parts by mass or less, even more preferably 44 parts by mass or less. If the blending amount of the mass adjusting agent is 1 part by mass or more, the density of the center composition can be more easily adjusted. If the blending amount is 50 parts by mass or less, the dispersibility of the mass adjusting agent into the resin component becomes better.

The center composition can be obtained, for example, by dry blending (A) the modified polyester elastomer and (B) the binary ionomer resin, followed by extruding and pelletizing. The dry blending may be carried out using for example, a mixer capable of blending a raw material in the form of pellet, more preferably a tumbler type mixer. In addition to the dry blending, the materials may be supplied respectively by the respective feeding machines. Extruding can be carried out by publicly known extruders such as a single-screw kneading extruder, a twin-screw kneading extruder, and a twin-single kneading extruder. The extruding condition is not particularly limited. For example, in the case of extruding with a twin-screw kneading extruder, the preferable conditions are screw diameter=45 mm; screw revolutions=50 rpm to 400 rpm; screw L/D=35 or less, and die temperature; 140° C. to 250° C. If desired, the modification of the polyester elastomer and the blending of the binary ionomer resin with the resultant modified polyester elastomer can be conducted at the same time by adding the binary ionomer resin as well as the radical generator and the unsaturated carboxylic acid to the polyester elastomer when preparing (A) the modified polyester elastomer.

The melt flow rate (230° C., 2.16 kg) of the center composition is preferably 3 g/10 min or more, more preferably 5 g/10 min or more, and even more preferably 7 g/10 min or more, and is preferably 30 g/10 min or less, more preferably 27 g/10 min or less, and even more preferably 25 g/10 min or less. If the melt flow rate of the center composition is 3 g/10 min or more, the moldability is enhanced.

The center composition preferably has a flexural modulus of 150 MPa or more, more preferably 155 MPa or more, even more preferably 160 MPa or more, and preferably has a flexural modulus of 450 MPa or less, more preferably 430 MPa or less, even more preferably 400 MPa or less. If the flexural modulus of the center composition is 150 MPa or more, it is possible to make the golf ball have an outer-hard and inner soft structure, resulting in a great flight distance. If the flexural modulus of the center composition is 450 MPa or less, the obtained golf ball becomes appropriately soft and the shot feeling becomes better.

The center composition preferably has a rebound resilience of 55% or more, more preferably 56% or more, even more preferably 57% or more. If the rebound resilience of the center composition is 55% or more, the obtained golf ball travels a great distance. Herein, the flexural modulus and the rebound resilience of the center composition are the flexural modulus and the rebound resilience of the center composition molded into a sheet form and measured by a method described later.

The center composition preferably has a maximum loss factor (tan δ) of 0.08 or less, more preferably 0.07 or less, even more preferably 0.06 or less, and preferably has a maximum loss factor (tan δ) of 0.01 or more, more preferably 0.02 or more, even more preferably 0.03 or more, between −20° C. and 0° C. If the maximum value of the loss factor (tan δ) between −20° C. and 0° C. falls within the above range, the desirable resilience is obtained.

The center composition preferably has a slab hardness of 40 or more, more preferably 41 or more, even more preferably 42 or more, and preferably has a slab hardness of 60 or less, more preferably 59 or less, even more preferably 58 or less in Shore D hardness. If the center composition has the slab hardness of 40 or more in Shore D, the golf ball having more excellent resilience (distance) is obtained. On the other hand, if the center composition has the slab hardness of 60 or less in Shore D hardness, the obtained golf ball has higher durability. Herein, the slab hardness of the center composition means the hardness of the center composition molded into a sheet form and is measured by a later described method.

The melt flow rate, flexural modulus, rebound resilience, and slab hardness of the center composition can be adjusted by appropriately selecting kinds, content or the like of (A) component, (B) component and (C) component.

(3) Envelope Layer Composition

As materials for the envelope layer, a rubber composition, a resin, or an elastomer used for the cover or the intermediate layer may be employed. The envelope layer of the golf ball of the present invention is preferably formed from a rubber composition (hereinafter, referred to as "envelope layer rubber composition" occasionally). Examples of the envelope layer rubber composition include, for example, a rubber composition containing a base rubber, a crosslinking initiator, a co-crosslinking agent and a filler.

As the base rubber, a natural rubber and/or a synthetic rubber such as a polybutadiene rubber, a natural rubber, a polyisoprene rubber, a styrene polybutadiene rubber, and ethylene-propylene-diene terpolymer (EPDM) may be used. Among them, typically preferred is the high cis-polybutadiene having cis-1,4-bond in a proportion of 40% or more, more preferably 70% or more, even more preferably 90% or more in view of its superior repulsion property.

The crosslinking initiator is blended to crosslink the base rubber component. As the crosslinking initiator, an organic peroxide is preferably used. Examples of the organic peroxide for use in the present invention are dicumyl peroxide, 1,1-bis(t-butylperoxy)-3,3,5-trimethylcyclohexane, 2,5-dimethyl-2,5-di(t-butylperoxy)hexane, and di-t-butyl peroxide. Among them, dicumyl peroxide is preferable. An amount of the crosslinking initiator to be blended in the rubber composition is preferably 0.3 part by mass or more, more preferably 0.4 part by mass or more, and is preferably 5 parts by mass or less, more preferably 3 parts by mass or less based on 100 parts by mass of the base rubber. If the amount is less than 0.3 part by mass, the envelope layer becomes too soft, and the resilience tends to be lowered, and if the amount is more than 5 parts by mass, the amount of the co-crosslinking agent must be increased in order to obtain the appropriate hardness, and thus the resilience is likely to be lowered.

The co-crosslinking agent is not particularly limited, as long as it has the effect of crosslinking a rubber molecule by graft polymerization to a base rubber molecular chain; for example, an α,β-unsaturated carboxylic acid having 3 to 8 carbon atoms or a metal salt thereof, more preferably acrylic acid, methacrylic acid or a metal salt thereof may be used. As the metal constituting the metal salt, for example, zinc, magnesium, calcium, aluminum and sodium may be used, and among them, zinc is preferred because it provides high resilience.

The amount of the co-crosslinking agent to be used is preferably 10 parts or more, more preferably 15 parts or more, even more preferably 20 parts or more, and is preferably 55 parts or less, more preferably 50 parts or less, even more preferably 48 parts or less based on 100 parts of the base rubber by mass. If the amount of the co-crosslinking agent to be used is less than 10 parts by mass, the amount of the crosslinking initiator must be increased to obtain an appropriate hardness, which tends to lower the resilience. On the other hand, if the amount of the co-crosslinking agent to be used is more than 55 parts by mass, the envelope layer becomes too hard, so that the shot feeling may be lowered.

The filler contained in the envelope layer rubber composition is mainly blended as a mass adjusting agent in order to adjust the density of the golf ball obtained as the final product in the range of 1.0 g/cm$^3$ to 1.5 g/cm$^3$, and may be blended as required. Examples of the filler include an inorganic filler such as zinc oxide, barium sulfate, calcium carbonate, magnesium oxide, tungsten powder, and molybdenum powder. The amount of the filler to be blended in the envelope layer rubber composition is preferably 0.5 part or more, more preferably 1 part or more, and is preferably 30 parts or less, more preferably 20 parts or less based on 100 parts of the base rubber by mass. If the amount of the filler to be blended is less than 0.5 part by mass, it becomes difficult to adjust the mass, while if it is more than 30 parts by mass, the weight ratio of the rubber component becomes small and the resilience tends to be lowered.

As the envelope layer rubber composition, an organic sulfur compound, an antioxidant or a peptizing agent may be blended appropriately in addition to the base rubber, the crosslinking initiator, the co-crosslinking agent and the filler.

As the organic sulfur compound, diphenyldisulfide or a derivative thereof may be preferably used. Examples of the diphenyldisulfide or the derivative thereof include diphenyldisulfide; a mono-substituted diphenyldisulfide such as bis(4-chlorophenyl)disulfide, bis(3-chlorophenyl)disulfide, bis(4-bromophenyl)disulfide, bis(3-bromophenyl)disulfide, bis(4-fluorophenyl)disulfide, bis(4-iodophenyl)disulfide and bis(4-cyanophenyl)disulfide; a di-substituted diphenyldisulfide such as bis(2,5-dichlorophenyl)disulfide, bis(3,5-dichlorophenyl)disulfide, bis(2,6-dichlorophenyl)disulfide, bis(2,5-dibromophenyl)disulfide, bis(3,5-dibromophenyl)disulfide, bis(2-chloro-5-bromophenyl)disulfide, and bis(2-cyano-5-bromophenyl)disulfide; a tri-substituted diphenyldisulfide such as bis(2,4,6-trichlorophenyl)disulfide, and bis(2-cyano-4-chloro-6-bromophenyl)disulfide; a tetra-substituted diphenyldisulfide such as bis(2,3,5,6-tetra chlorophenyl)disulfide; a penta-substituted diphenyldisulfide such as bis(2,3,4,5,6-pentachlorophenyl)disulfide and bis(2,3,4,5,6-pentabromophenyl)disulfide. These diphenyldisulfides or the derivative thereof can enhance resilience by having some influence on the state of vulcanization of vulcanized rubber. Among them, diphenyldisulfide and bis(pentabromophenyl)disulfide are preferably used since a golf ball having particularly high resilience can be obtained. The amount of the organic sulfur compound to be blended is preferably 0.1 part by mass or more, more preferably 0.3 part by mass or more, and is preferably 5.0 parts by mass or less, more preferably 3.0 parts by mass or less relative to 100 parts by mass of the base rubber.

The amount of the antioxidant to be blended is preferably 0.1 part or more and is preferably 1 part or less based on 100 parts of the base rubber by mass. Further, the amount of the peptizing agent is preferably 0.1 part or more and is preferably 5 parts or less based on 100 parts of the base rubber by mass.

(4) Intermediate Layer Composition

An intermediate layer composition containing a resin component is preferably used for the intermediate layer. Examples of the resin component include ionomer resins, styrene block-containing thermoplastic elastomers, thermoplastic polyurethane elastomers, thermoplastic polyamide elastomers, thermoplastic polyester elastomers and thermoplastic polyolefin elastomers. Among these, ionomer resins are preferred as the resin component. Ionomer resins are highly elastic.

An ionomer resin and another resin may be used in combination. In this case, in light of the resilience performance, the ionomer resin is the principal component of the resin component. The content of the ionomer resin in the resin component is preferably 50 mass % or more, more preferably 70 mass % or more, and even more preferably 85 mass % or more.

Examples of the ionomer resin include, for example, one prepared by neutralizing at least a part of carboxyl croups in a binary copolymer composed of an olefin and an α,β-unsaturated carboxylic acid having 3 to 8 carbon atoms with a metal ion, one prepared by neutralizing at least a part of carboxyl groups in a ternary copolymer composed of an olefin, an α,β-unsaturated carboxylic acid having 3 to 8 carbon atoms and an α,β-unsaturated carboxylic acid ester, or a mixture of them. The olefin preferably includes an olefin having 2 to 8 carbon atoms. Examples of the olefin include ethylene, propylene, butene, pentene, hexene, heptene and octene. Among them, ethylene is more preferred. Examples of the α,β-unsaturated carboxylic acid having 3 to 8 carbon atoms are acrylic acid, methacrylic acid, fumaric acid, maleic acid and crotonic acid. Among these, acrylic acid or methacrylic acid is particularly preferred. Examples of the α,β-unsaturated carboxylic acid ester are methyl, ethyl, propyl, n-butyl, isobutyl ester and the like of acrylic acid, methacrylic acid, fumaric acid and maleic acid. Particularly, acrylic acid ester and methacrylic acid ester are preferred. Among them, as the ionomer resin, preferred are a metal ion-neutralized product of the binary copolymer composed of ethylene- (meth)acrylic acid and a metal ion-neutralized product of the ternary copolymer composed of ethylene-(meth)acrylic acid-(meth)acrylic acid ester.

Specific examples of the ionomer resin include trade name "Himilan (registered trademark) (e.g. Himilan 1555 (Na), Himilan 1557 (Zn), Himilan 1605 (Na), Himilan 1706 (Zn), Himilan 1707 (Na), Himilan AM3711 (Mg))", and specific examples of the ternary ionomer resin include "Himilan 1856 (Na) and Himilan 1855 (Zn)" commercially available from Du Pont-Mitsui Polychemicals Co., Ltd.

Further, examples of the ionomer resin include "Surlyn (registered trademark) (e.g. Surlyn 8945 (Na), Surlyn 9945 (Zn), Surlyn 8140 (Na), Surlyn 8150 (Na), Surlyn 9120 (Zn), Surlyn 9150 (Zn), Surlyn 6910 (Mg), Surlyn 6120 (Mg), Surlyn 7930 (Li), Surlyn 7940 (Li), Surlyn AD8546 (Li))", and specific examples of the ternary ionomer resin include "Surlyn 8120 (Na), Surlyn 8320 (Na), Surlyn 9320 (Zn), Surlyn 6320 (Mg), HPF1000 (Mg), HPF2000 (Mg)" commercially available from E.I. du Pont de Nemours and Company.

Specific examples of the ionomer resin include "lotek (registered trademark) (e.g. lotek 8000 (Na), lotek 8030 (Na), lotek 7010 (Zn), lotek 7030 (Zn)", and specific examples of the ternary ionomer resin include "lotek 7510 (Zn) and lotek 7520 (Zn)" commercially available from Exxon Mobile Chemical Corporation.

It is noted that Na, Zn, Li, and Mg described in the parentheses after the trade names indicate metal types of neutralizing metal ions of the ionomer resins. The ionomer resins may be used alone or as a mixture of at least two of them.

As described the above, the intermediate layer of the golf ball of the present invention is preferably hard. Use of an ionomer resin having a high acid content provides a hard intermediate layer. The acid content is preferably 10 mass % or more and 30 mass % or less. Specific examples of the ionomer resin having a high acid content include the aforementioned "Himilan 1605, Himilan 1706, Himilan 1707, Himilan AM7311, Himilan AM7317, Himilan AM7318, Himilan AM 7329, Surlyn 6120, Surlyn 6910, Surlyn 7930, Surlyn 7940, Surlyn 8945, Surlyn 9120, Surlyn 9150, Surlyn 9910, Surlyn 9945, Surlyn AD8546, lotek 8000, and lotek 8030".

(5) Reinforcing Layer Composition

The reinforcing layer is formed from a reinforcing layer composition containing a resin component. As the resin component, a two-component curing type thermosetting resin is preferably used. Specific examples of two-component curing type thermosetting resin include epoxy resins, urethane resins, acrylic resins, polyester resins and cellulose resins. In light of the strength and durability of the reinforcing layer, two-component curing type epoxy resins and two-component curing type urethane resins are preferred.

The reinforcing layer composition may include additives such as a coloring agent (for example, titanium dioxide), a phosphate-based stabilizer, an antioxidant, a light stabilizer, a fluorescent brightener, an ultraviolet absorber, an anti-blocking agent and the like. The additives may be added to either the base material or the curing agent of the two-component curing thermosetting resin.

(6) Cover Composition

The cover of the golf ball of the present invention is formed from a cover composition containing a resin component. Examples of the resin components include an ionomer resin, a thermoplastic polyamide elastomer having a trade name "Pebax (registered trademark) (e.g. "Pebax 2533")" commercially available from Arkema Inc., a thermoplastic polyester elastomer having a trade name "Hytrel (registered trademark) (e.g. "Hytrel 3548" and "Hytrel 4047")" commercially available from Du Pont-Toray Co., Ltd., a thermoplastic polyurethane elastomer having a trade name "Elastollan (registered trademark)" commercially available from BASF Japan Ltd., a thermoplastic styrene elastomer having a trade name "Rabalon (registered trademark)" commercially available from Mitsubishi Chemical Corporation, and the like. These resin components may be used alone or in combination of two or more thereof.

The cover composition constituting the cover of the golf ball of the present invention preferably contains the thermoplastic polyurethane or the ionomer resin as a resin component. The content of the thermoplastic polyurethane or the ionomer resin in the resin component of the cover composition is preferably 50 mass % or more, more preferably 60 mass % or more, even more preferably 70 mass % or more.

The cover composition may contain a pigment component such as a white pigment (for example, titanium oxide), a blue pigment, a red pigment, or the like, a specific gravity adjusting agent such as zinc oxide, calcium carbonate, barium sulfate, or the like, a dispersant, an antioxidant, an ultraviolet absorber, a light stabilizer, a fluorescent material or a fluorescent brightener, or the like as long as they do not impair the performance of the cover.

The amount of the white pigment (for example, titanium oxide), with respect to 100 parts by mass of the resin component for forming the cover, is preferably 0.5 part by mass or more and more preferably 1 part by mass or more, and is preferably 10 parts by mass or less and more preferably 8 parts by mass or less. If the amount of the white pigment is 0.5 part by mass or more, it is possible to impart opacity to the cover. If the amount of the white pigment is more than 10 parts by mass, the durability of the resultant cover may deteriorate.

(7) Process for Producing Golf Ball

The center used in the present invention is molded by injection molding the center composition. Specifically, the center composition heated and melted at the temperature of 160° C. to 260° C. is charged into a mold held under the pressure of 1 MPa to 100 MPa for 1 to 100 seconds. After cooling for 30 to 300 seconds, the mold is opened and the center molded is taken out from the mold.

For molding the envelope layer and intermediate layer, publicly known methods such as injection molding, compression molding and the like can be employed. In light of productivity, injection molding is preferred. In case of using a rubber composition as the envelope layer composition, the envelope layer composition was first kneaded and the upper die for molding a center in the state that the center was set therein and a lower die for molding a core were clamped in a manner that a necessary amount of the envelope layer composition was brought into contact with a half of the surface of the center and heat pressing was carried out to produce an intermediate core molded product having an envelope layer formed on a half of the surface of the center. Next, the lower die for molding the core in the state that the envelope layer of the intermediate core molded product was housed and an upper die for molding a core were clamped in a manner that a necessary amount of the envelope layer composition was brought into contact with the other half of the surface of the center and heat pressing was carried out to produce a core having an envelope layer on the other half of the surface of the center. Then, the core was heat pressed at the temperature of 170° C. for 30 minutes to form a core.

In case of forming the envelope layer and the intermediate layer by injection molding, it is preferred to use upper and lower molds having a spherical cavity and pimples, wherein a part of the pimple also serves as a retractable hold pin. When forming the envelope layer and intermediate layer by injection molding, the hold pin is protruded to hold the center, and the resin composition which has been heated and melted is charged and then cooled to obtain the envelope layer and the intermediate layer. For example, the resin composition heated and melted at the temperature of 150° C. to 230° C. is charged into a mold held under the pressure of 980 KPa to 1,500 KPa for 0.1 to 1 second. After cooling for 15 to 60 seconds, the mold is opened.

The molding temperature means the highest temperature where the temperature at the surface of the concave portion of the lower mold reaches from closing through opening the molds. Further, the flow beginning temperature of the composition can be measured in a pellet form with the following conditions by using a flow characteristics evaluation apparatus (Flow Tester CFT-500D, manufactured by Shimadzu Corporation).

Measuring conditions: Area size of a plunger: 1 $cm^2$, Die length: 1 mm, Die diameter: 1 mm, Load: 588.399 N, Start temperature: 30° C., and Temperature increase rate: 3° C./min.

The reinforcing layer is obtained by applying, to the surface of the intermediate layer, liquids where the base material or the curing agent are dissolved or dispersed in a solvent. In light of workability, application with a spray gun is preferred. After the application, the solvent is volatilized to permit a reaction of the base material with the curing agent, thereby forming the reinforcing layer.

An embodiment for molding a cover is not particularly limited, and includes an embodiment which comprises injection molding the cover composition directly onto the core, or an embodiment which comprises molding the cover composition into a hollow-shell, covering the core with a plurality of the hollow-shells and subjecting the core with a plurality of the hollow shells to the compression-molding (preferably an embodiment which comprises molding the cover composition into a half hollow-shell, covering the core with the two half hollow-shells, and subjecting the core with the two half hollow-shells to the compression-molding).

When molding the cover in a compression molding method, molding of the half shell can be performed by either compression molding method or injection molding method, and the compression molding method is preferred. The compression-molding of the cover composition into a half shell can be carried out, for example, under a pressure of 1 MPa or more and 20 MPa or less at a temperature of −20° C. or more and 70° C. or less relative to the flow beginning temperature of the cover composition. By performing the molding under the above conditions, a half shell having a uniform thickness can be formed. Examples of a method for molding the cover using half shells include compression molding by covering the core with two half shells. The compression molding of half shells into the cover can be carried out, for example, under a pressure of 0.5 MPa or more and 25 MPa or less at a temperature of −20° C. or more and 70° C. or less relative to the flow beginning temperature of the cover composition. By performing the molding under the above conditions, a cover for a golf ball having a uniform thickness can be formed.

In the case of directly injection molding the cover composition to form a cover, the cover composition in the form of a pellet obtained by extrusion may be used for injection molding, or the cover materials such as the base resin component, the pigment and the like may be dry blended, followed by directly injection molding. It is preferred to use upper and lower molds having a spherical cavity and pimples for forming a cover, wherein a part of the pimple also serves as a retractable hold pin. When forming the cover by injection molding, the hold pin is protruded to hold the core, and the cover composition which has been heated and melted is charged and then cooled to obtain a cover. For example, the cover composition heated and melted at the temperature of 200° C. to 250° C. is charged into a mold held under the pressure of 9 MPa to 15 MPa for 0.5 to 5 second. After cooling for 10 to 60 seconds, the mold is opened. When molding a cover, the concave portions called "dimple" are usually formed on the surface.

The golf ball body with the cover molded is taken out from the mold, and as necessary, the golf ball body is preferably subjected to surface treatments such as deburring, cleaning, and sandblast. If desired, a paint film or a mark may be formed. The paint film preferably has a thickness of, but not limited to 5 μm or larger, and more preferably 7 μm or larger, and preferably has a thickness of 50 μm or smaller, more preferably 40 μm or smaller, and even more preferably 30 μm or smaller. If the thickness is smaller than 5 μm, the paint film is easy to wear off due to continued use of the golf ball, and if the thickness is larger than 50 μm, the effect of the dimples is reduced, resulting in deteriorating flying performance of the golf ball.

EXAMPLES

Hereinafter, the present invention will be described in detail by way of example. The present invention is not limited to examples described below. Various changes and modifications can be made without departing from the spirit and scope of the present invention.

[Evaluation Methods]

(1) Hardness of Center and Spherical Core (JIS-C Hardness)

A type P1 auto loading durometer manufactured by Kobunshi Keiki Co., Ltd., provided with a JIS-C type spring hardness tester was used to measure the surface hardness of the center and the spherical core. JIS-C hardness measured at the surfaces of the center and the spherical core were employed as the surface hardness of the center and the surface hardness of the spherical core, respectively. The spherical core was cut into two hemispheres to obtain a cut plane, and a JIS-C hardness measured at the central point of the cut plane was employed as the central hardness of the center (spherical core) hardness. Furthermore, a JIS-C hardness was measured at a predetermined point from the central point of the cut plane.

(2) Slab Hardness (JIS-C Hardness, Shore D Hardness)

Sheets with a thickness of about 2 mm were formed from the envelope layer composition, the intermediate layer composition or the cover composition and stored at 23° C. for two weeks. Three or more of these sheets were stacked on one another so as not to be affected by the measuring base plate on which the sheets were placed, and the stack was measured with an auto loading durometer manufactured by Kobunshi Keiki Co., Ltd., provided with a JIS-C type spring hardness tester or Shore D type spring hardness tester prescribed in ASTM-D2240.

(3) Compression Deformation Amount (mm)

A compression deformation amount of the center, spherical core or golf ball (a shrinking amount of the center, spherical core or golf ball in the compression direction thereof), when applying a load from an initial load of 98 N to a final load of 1275 N, was measured.

(4) Melt Flow Rate (MFR) (g/10 min)

The MFR was measured using a flow tester (Shimadzu flow tester CFT-100C manufactured by Shimadzu Corporation) in accordance with JIS K7210. The measurement was conducted under the conditions of the measurement temperature 190° C. or 230° C. and the load of 2.16 kg.

(5) Flexural Modulus (MPa) (3 Points Bending Test, MPa)

Sheets having a thickness about 2 mm were produced by heat-pressing the ionomer resin or the center composition, and stored at 23° C. for two weeks. The flexural modulus was measured according to JIS K7171. The measurement was conducted at a temperature of 23° C. and a humidity of 50% RH.

(6) Rebound Resilience (%)

A sheet with a thickness of about 2 mm was produced by a heat press molding from the center composition. A circle-shaped test piece having a diameter of 28 mm was cut out of this sheet, and 6 pieces of the test piece were stacked to prepare a cylindrical test piece having a thickness of about 12 mm and a diameter of 28 mm. The cylindrical test piece was subjected to the Lupke type rebound resilience test (testing temperature 23° C., humidity 50 RH %). Preparation of the test piece and the testing method are based on JIS K6255.

(7) Measurement of Loss Factor (tan δ)

Sheets with a thickness of 0.5 mm were produced from the center composition. Test pieces having a length of 30 mm, a width of 4 mm, and a thickness of 0.5 mm in a plate-like form were cut out from these sheets. The both ends of test pieces were claimed with chucks so that the length of displacement becomes 20 mm. The Loss factor was measured under the following conditions using Viscoelasticity spectrometer Rheogel-E4000 available from UBM CO., Ltd to determine the Maximum Loss Factor (tan δ) between −20° C. to 0° C.

Initial load: Auto static load 200%

Amplitude: 0.025%

Frequency: 10 Hz

Initial temperature: −100° C.

End temperature: 100° C.

Temperature increasing rate: 4° C./min

Measuring mode: tensile mode (8) Coefficient of Restitution

A 198.4 g of metal cylindrical object was forced to collide with each golf ball at a speed of 40 m/sec, and the speeds of the cylindrical object and the golf ball or the spherical core before and after the collision were measured. Based on these speeds and the mass of each object, coefficient of restitution for each golf ball or the spherical core was calculated. The measurement was conducted by using twelve samples for each golf ball or spherical core, and the average value was regarded as the coefficient of restitution for the golf ball or spherical core.

(9) Density of Center, Envelope Layer, Intermediate Layer

Volumes of the center, envelope layer and intermediate layer were calculated based on the diameter, thickness thereof. Mass of the center was measured with a mass scale. Mass of the envelope layer and intermediate layer were calculated based on the mass before and after molding them, respectively. Density was calculated from volume and mass thereof.

(10) Spin Rate on Approach Shots

An approach wedge (SRIXON I-302, Shaft S available from SRI Sports Limited) was installed on a swing robot available from Golf Laboratories, Inc. Golf balls were hit at a head speed of 21 m/sec., and a sequence of photographs of the hit golf ball were taken for measuring the spin rate (rpm). The measurement was performed ten times for each golf ball, and the average value is regarded as the spin rate (rpm).

[Preparation of Modified Polyester Elastomer]

(1) Modified Polyester Elastomer 1

100 parts by mass of a polyester elastomer containing 65 mass % of polytetramethylene glycol and 35 mass % of polybutylene terephthalate and 0.5 parts by mass of maleic anhydride (pulverized product), and 0.13 parts by mass of benzoyl peroxide (50% water-containing product, NYPER BWK) were mixed with a mixer, and extruded with a twin screw extruder (TEX54a manufactured by The Japan Steel Works, Ltd.) at the conditions of 200° C., 250 revolutions, and 250 kg/hr for a graft reaction of maleic anhydride to produce a modified polyester elastomer 1. The obtained modified polyester elastomer 1 contained maleic acid component in a content of 0.4 mass %, and had Shore A hardness of 84, and a melt flow rate (230° C., 21N) of 24 g/10 min.

(2) Modified Polyester Elastomer 2

The modified polyester elastomer 2 was produced in the same manner as in Modified Polyester Elastomer 1 except for using a polyester elastomer containing 77 mass % of polytetramethylene glycol and 23 mass % of polybutylene terephthalate. The obtained modified polyester elastomer 2 contained maleic acid component in a content of 0.5 mass %, and had Shore A hardness of 80, and a melt flow rate (230° C., 21N) of 30 g/10 min.

[Production of Golf Balls]

(1) Production of Center

Blending materials shown in Tables 1 to 3 were dry blended, and extruded with a twin-screw kneading extruder into water in the form of a strand. The extruded strand was cut by a pelletizer to prepare the center composition in the form of the pellet. The extruding conditions were a screw diameter of 45 mm, a screw rotational speed of 200 rpm, and screw L/D=35, and the mixtures were heated to 160 to 230° C. at the die position of the extruder. The center composition in the form of the pellet was injection molded into the spherical boy (center) at the temperature in a range from 200° C. to 270° C.

TABLE 1

| Golf ball No. | | | | | 1 | 2 | 3 | 4 | 5 |
|---|---|---|---|---|---|---|---|---|---|
| Center composition | Formulation (parts by mass) | Resin Component | (A) | Modified Polyester Elastomer 1 | 40 | 40 | — | — | 40 |
| | | | | Modified Polyester Elastomer 2 | — | — | 40 | 45 | — |
| | | | | Slab hardness (Shore A) | 84 | 84 | 80 | 80 | 84 |
| | | | (B) | HPF 1000 | — | — | — | — | — |
| | | | | Surlyn 8150 | 36 | 36 | 36 | 33 | — |
| | | | | Surlyn 8945 | — | — | — | — | 36 |
| | | | | Surlyn 9150 | 24 | 24 | 24 | 22 | — |
| | | | | Himilan AM7329 | — | — | — | — | 24 |
| | | | | Shore D hardness | 68 | 68 | 68 | 68 | 65 |
| | | | | Flexural modulus (MPa) | 450 | 450 | 450 | 450 | 330 |
| | | | | MFR(190° C. × 2.16 kg, g/10 min) | 5 | 5 | 5 | 5 | 5 |
| | | | (C) | TPEE | — | — | — | — | — |
| | Properties | Slab hardness (Shore D) | | | 55 | 55 | 52 | 50 | 52 |
| | | Flexural modulus (MPa) | | | 260 | 260 | 230 | 235 | 215 |
| | | Max Loss Factor (tan δ, −20° C. to 0° C.) | | | 0.05 | 0.05 | 0.05 | 0.05 | 0.05 |
| | | Rebound resilience (%) | | | 60 | 60 | 57 | 57 | 57 |

TABLE 1-continued

| Golf ball No. | | 1 | 2 | 3 | 4 | 5 |
|---|---|---|---|---|---|---|
| Center | Diameter (mm) | 15 | 20 | 15 | 15 | 15 |
| | Surface hardness (JIS-C) | 78 | 78 | 75 | 73 | 75 |
| | Density (g/cm$^3$) | 1.01 | 1.01 | 1.01 | 1.01 | 1.01 |
| Envelope layer | Envelope layer composition | B | B | B | B | B |
| | Thickness (mm) | 12.4 | 9.9 | 12.4 | 12.4 | 12.4 |
| | Density (g/cm$^3$) | 1.12 | 1.12 | 1.12 | 1.12 | 1.12 |
| Spherical Core | Diameter (mm) | 39.8 | 39.8 | 39.8 | 39.8 | 39.8 |
| | Weight (g) | 37.5 | 37.5 | 37.5 | 37.5 | 37.5 |
| | Compression deformation amount (mm) | 2.6 | 2.4 | 2.6 | 2.6 | 2.6 |
| | Coefficient of restitution | 0.785 | 0.782 | 0.783 | 0.781 | 0.778 |
| Spherical core hardness distribution (JIS-C) | Center hardness | 78 | 78 | 75 | 73 | 75 |
| | 5 mm | 78 | 78 | 75 | 73 | 75 |
| | 1 mm inside center/envelope layer boundary | 79 | 79 | 76 | 74 | 76 |
| | 1 mm outside center/envelope layer boundary | 77 | 78 | 75 | 73 | 75 |
| | 10 mm from center | 76 | — | 74 | 72 | 74 |
| | 15 mm from center | 80 | 80 | 78 | 76 | 78 |
| | Surface hardness | 87 | 87 | 87 | 87 | 87 |
| | Hardness difference between surface and center | 9 | 9 | 12 | 14 | 12 |
| Intermediate layer | Thickness (mm) | 1.0 | 1.0 | 1.0 | 1.0 | 1.0 |
| | Density (g/cm$^3$) | 1.05 | 1.05 | 1.05 | 1.05 | 1.05 |
| | Slab hardness (Shore D) | 65 | 65 | 65 | 65 | 65 |
| Cover | Thickness (mm) | 0.5 | 0.5 | 0.5 | 0.5 | 0.5 |
| | Slab hardness (Shore D) | 47 | 47 | 47 | 47 | 47 |
| Golf ball | Spin rate (rpm) | 7000 | 7100 | 6750 | 6700 | 6750 |

Formulation: parts by mass,
MFR: Melt flow rate

TABLE 2

| Golf ball No. | | | | 6 | 7 | 8 | 9 | 10 |
|---|---|---|---|---|---|---|---|---|
| Center composition | Formulation (parts by mass) | Resin Component | (A) Modified Polyester Elastomer 1 | 30 | 30 | 50 | 60 | — |
| | | | Modified Polyester Elastomer 2 | — | — | — | — | — |
| | | | Slab hardness (Shore A) | 84 | 84 | 84 | 84 | — |
| | | | (B) HPF 1000 | — | — | — | — | — |
| | | | Surlyn 8150 | — | 36 | 30 | 24 | 30 |
| | | | Surlyn 8945 | 42 | — | — | — | — |
| | | | Surlyn 9150 | — | 24 | 20 | 16 | 30 |
| | | | Himilan AM7329 | 28 | — | — | — | — |
| | | | Shore D hardness | 65 | 68 | 68 | 68 | 68 |
| | | | Flexural modulus (MPa) | 330 | 450 | 450 | 450 | 450 |
| | | | MFR(190° C. × 2.16 kg, g/10 min) | 5 | 5 | 5 | 5 | 5 |
| | | | (C) TPEE | — | 10 | — | — | 40 |
| | Properties | Slab hardness (Shore D) | | 52 | 54 | 51 | 51 | 55 |
| | | Flexural modulus (MPa) | | 200 | 210 | 195 | 178 | 270 |
| | | Max Loss Factor (tan δ, −20° C. to 0° C.) | | 0.05 | 0.05 | 0.05 | 0.05 | 0.05 |
| | | Rebound resilience (%) | | 57 | 60 | 62 | 62 | 57 |
| Center | | Diameter (mm) | | 15 | 15 | 15 | 15 | 15 |
| | | Surface hardness (JIS-C) | | 75 | 76 | 74 | 74 | 65 |
| | | Density (g/cm$^3$) | | 1.01 | 1.01 | 1.01 | 1.01 | 1.01 |
| Envelope layer | | Envelope layer composition | | B | B | B | B | A |
| | | Thickness (mm) | | 12.4 | 12.4 | 12.4 | 12.4 | 12.4 |
| | | Density (g/cm$^3$) | | 1.12 | 1.12 | 1.12 | 1.12 | 1.12 |
| Spherical Core | | Diameter (mm) | | 39.8 | 39.8 | 39.8 | 39.8 | 39.8 |
| | | Weight (g) | | 37.50 | 37.50 | 37.5 | 37.5 | 37.5 |
| | | Compression deformation amount (mm) | | 2.6 | 2.6 | 2.6 | 2.6 | 2.8 |
| | | Coefficient of restitution | | 0.780 | 0.779 | 0.781 | 0.779 | 0.775 |
| Spherical core hardness distribution (JIS-C) | | Center hardness | | 75 | 76 | 74 | 74 | 65 |
| | | 5 mm | | 75 | 76 | 74 | 74 | 65 |
| | | 1 mm inside center/envelope layer boundary | | 76 | 77 | 75 | 75 | 66 |
| | | 1 mm outside center/envelope layer boundary | | 75 | 76 | 74 | 74 | 65 |
| | | 10 mm from center | | 74 | 75 | 73 | 73 | 64 |
| | | 15 mm from center | | 78 | 79.0 | 77 | 77 | 68 |
| | | Surface hardness | | 87 | 87 | 87 | 87 | 87 |
| | | Hardness difference between surface and center | | 12 | 11 | 13 | 13 | 22 |
| Intermediate layer | | Thickness (mm) | | 1.0 | 1.0 | 1.0 | 1.0 | 1.0 |
| | | Density (g/cm$^3$) | | 1.05 | 1.05 | 1.05 | 1.05 | 1.05 |
| | | Slab hardness (Shore D) | | 65 | 65 | 65 | 65 | 65 |
| Cover | | Thickness (mm) | | 0.5 | 0.5 | 0.5 | 0.5 | 0.5 |
| | | Slab hardness (Shore D) | | 47 | 47 | 47 | 47 | 47 |
| Golf ball | | Spin rate (rpm) | | 6800 | 6850 | 6800 | 6800 | 6500 |

Formulation: parts by mass,
MFR: Melt flow rate

TABLE 3

| Golf ball No. | | | | 11 | 12 | 13 | 14 | 15 |
|---|---|---|---|---|---|---|---|---|
| Center composition | Formulation (parts by mass) | Resin Component | (A) Modified Polyester Elastomer 1 | 20 | 80 | — | — | — |
| | | | Modified Polyester Elastomer 2 | — | — | — | — | — |
| | | | Slab hardness (Shore A) | 84 | 84 | — | — | — |
| | | | (B) HPF 1000 | — | — | — | 100 | 100 |
| | | | Surlyn 8150 | 40 | 10 | 24 | — | — |
| | | | Surlyn 8945 | — | — | — | — | — |
| | | | Surlyn 9150 | 40 | 10 | 16 | — | — |
| | | | Himilan AM7329 | — | — | — | — | — |
| | | | Shore D hardness | 68 | 68 | 68 | — | — |
| | | | Flexural modulus (MPa) | 450 | 450 | 450 | — | — |
| | | | MFR(190° C. × 2.16 kg, g/10 min) | 5 | 5 | 3.4 | — | — |
| | | | (C) TPEE | — | — | 60 | — | — |
| | Properties | Slab hardness (Shore D) | | 56 | 38 | 44 | 53 | 53 |
| | | Flexural modulus (MPa) | | 280 | 175 | 115 | 185 | 185 |
| | | Max Loss Factor (tan δ, −20° C. to 0° C.) | | 0.03 | 0.09 | 0.05 | 0.13 | 0.13 |
| | | Rebound resilience (%) | | 56 | 65 | 64 | 66 | 66 |
| Center | | Diameter (mm) | | 15 | 15 | 15 | 15 | 20 |
| | | Surface hardness (JIS-C) | | 78 | 74 | 73 | 75 | 75 |
| | | Density (g/cm$^3$) | | 1.01 | 1.01 | 1.01 | 0.96 | 0.96 |
| Envelope layer | | Envelope layer composition | | B | A | A | B | B |
| | | Thickness (mm) | | 12.4 | 12.4 | 12.4 | 12.4 | 9.9 |
| | | Density (g/cm$^3$) | | 1.12 | 1.12 | 1.12 | 1.12 | 1.12 |
| Spherical Core | | Diameter (mm) | | 39.8 | 39.8 | 39.8 | 39.8 | 39.8 |
| | | Weight (g) | | 37.5 | 37.5 | 37.5 | 37.3 | 37.3 |
| | | Compression deformation amount (mm) | | 2.6 | 2.6 | 2.6 | 2.6 | 2.4 |
| | | Coefficient of restitution | | 0.786 | 0.777 | 0.775 | 0.786 | 0.783 |
| Spherical core hardness distribution (JIS-C) | | Center hardness | | 78 | 74 | 73 | 75 | 75 |
| | | 5 mm | | 78 | 74 | 73 | 76 | 77 |
| | | 1 mm inside center/envelope layer boundary | | 79 | 75 | 74 | 74 | 75 |
| | | 1 mm outside center/envelope layer boundary | | 78 | 74 | 73 | 75 | 75 |
| | | 10 mm from center | | 77 | 73 | 72 | 76 | — |
| | | 15 mm from center | | 81 | 77 | 76 | 80 | 80 |
| | | Surface hardness | | 87 | 87 | 87 | 87 | 87 |
| | | Hardness difference between surface and center | | 9 | 13 | 14 | 12 | 12 |
| Intermediate layer | | Thickness (mm) | | 1.0 | 1.0 | 1.0 | 1.0 | 1.0 |
| | | Density (g/cm$^3$) | | 1.05 | 1.05 | 1.05 | 1.05 | 1.05 |
| | | Slab hardness (Shore D) | | 65 | 65 | 65 | 65 | 65 |
| Cover | | Thickness (mm) | | 0.5 | 0.5 | 0.5 | 0.5 | 0.5 |
| | | Slab hardness (Shore D) | | 47 | 47 | 47 | 47 | 47 |
| Golf ball | | Spin rate (rpm) | | 6650 | 6600 | 6600 | 6600 | 6600 |

Formulation: parts by mass,
MFR: Melt flow rate

As the center composition, the followings were used.

HPF100: a Magnesium ion neutralized ternary copolymer ionomer resin available from E.I. du Pont de Nemours and Company.

SURLYN 8150: a sodium ion neutralized ethylene-methacrylic acid binary copolymer ionomer resin (Acid content: 17 mass % or more, flexural modulus: 364 MPa, Melt Flow Rate (190° C., 2.16 kg): 4.5, Shore D hardness: 68) available from E.I. du Pont de Nemours and Company.

SURLYN 8945: a sodium ion neutralized ethylene-methacrylic acid copolymer ionomer resin (Acid content: 15 mass %, or less, flexural modulus: 254 MPa, Melt Flow Rate (190° C., 2.16 kg): 5, Shore D hardness: 61) available from E.I. du Pont de Nemours and Company.

SURLYN 9150: a zinc ion neutralized ethylene-methacrylic acid copolymer ionomer resin (Acid content: 17 mass % or more, flexural modulus: 252 MPa, Melt Flow Rate (190° C., 2.16 kg): 4.5, Shore D hardness: 64) available from E.I. du Pont de Nemours and Company.

HIMILAN AM7329: a zinc ion neutralized ethylene-methacrylic acid copolymer ionomer resin (Acid content: 15 mass % or less, flexural modulus: 240 MPa, Melt Flow Rate (190° C., 2.16 kg): 5, Shore D hardness: 59) available from Du Pont-Mitsui Polychemicals Co., Ltd.

TPEE: Thermoplastic polyester elastomer (65 mass % of polytetramethylene glycol and 35 mass % of polybuthylene telephthalate)

(2) Formation of Envelope Layer

The envelope layer rubber compositions No. A, and B shown in Table 4 were kneaded and the upper die for molding a center in the state that the center was set therein and a lower die for molding a core were clamped in a manner that a necessary amount of the envelope layer rubber composition was brought into contact with a half of the surface of the center and heat pressing was carried out to produce an intermediate core molded product having an envelope layer formed on a half of the surface of the center. Next, the lower die for molding the core in the state that the envelope layer of the intermediate core molded product was housed and an upper die for molding a core were clamped in a manner that a necessary amount of the envelope layer rubber composition was brought into contact with the other half of the surface of the center and heat pressing was carried out to produce a core having an envelope layer on the other half of the surface of the center. Then, the core was heat pressed at the temperature of 170° C. for 30 minutes to form a spherical core.

TABLE 4

| Envelope layer rubber composition No. | | A | B |
|---|---|---|---|
| Formulation (parts by mass) | Polybutadiene rubber | 100 | 100 |
| | Zinc acrylate | 36 | 30 |
| | Zinc oxide | 5 | 5 |
| | Barium sulfate | Appropriate amount | Appropriate amount |

TABLE 4-continued

| Envelope layer rubber composition No. | A | B |
|---|---|---|
| Bis(pentabromophenyl) disulfide | 0.3 | 0.3 |
| Dicumyl peroxide | 0.9 | 0.9 |

As the envelope layer composition, the followings were used.

Polybutadiene rubber: "BR-730 (high-cis polybutadiene)" manufactured by JSR Corporation Zinc acrylate: "ZNDA-90S" manufactured by Nihon Jyoryu Kogyo Co., Ltd.

Zinc oxide: "Ginrei R" manufactured by Toho Zinc Co., Ltd.

Barium sulfate: "Barium Sulfate BD" manufactured by Sakai Chemical Industry Co., Ltd.

Dicumyl peroxide: "Percumyl (registered trademark) D" manufactured by NOF Corporation As to an amount of barium sulfate, adjustment was made such that the golf ball had a mass of 45.5 g.

(3) Preparation of Intermediate Layer Composition and Cover Composition

Blending materials shown in Tables 5 to 6 were mixed with a twin-screw kneading extruder to prepare, intermediate layer compositions and cover compositions in the pellet form, respectively. The extruding conditions were a screw diameter of 45 mm, a screw rotational speed of 200 rpm, and screw L/D=35, and the mixtures were heated to 160° C. to 230° C. at the die position of the extruder. The intermediate layer compositions obtained above were injection-molded onto the spherical core to mold intermediate layers covering the spherical core. Upper and lower molds for the intermediate layer have a spherical cavity with pimples, a part of pimples serves a hold pin which is retractable. When molding the intermediate layer, the hold pins were protruded to hold the spherical core, the intermediate layer composition heated at 260° C. was charged into the mold under a pressure of 80 tons within 0.3 seconds, and cooled for 30 seconds. Then, the mold was opened, and spherical bodies were taken out from the mold.

TABLE 5

| Intermediate layer composition No. | A |
|---|---|
| SURLYN 8945 | 50 |
| HIMILAN AM7329 | 50 |
| Titanium oxide | Appropriate amount |
| Slab hardness (Shore D hardness) | 65 |

Formulation: parts by mass

As the intermediate layer, the following materials were used.

SURLYN 8945: a sodium ion neutralized ethylene-methacrylic acid copolymer ionomer resin (Acid content: 15 mass % or less, flexural modulus: 254 MPa, Melt Flow Rate (190° C., 2.16 kg): 5, Shore D hardness: 61) available from E.I. du Pont de Nemours and Company.

HIMILAN AM7329: a zinc ion neutralized ethylene-methacrylic acid copolymer ionomer resin (Acid content: 15 mass % or less, flexural modulus: 240 MPa, Melt Flow Rate (190° C., 2.16 kg): 5, Shore D hardness: 59) available from Du Pont-Mitsui Polychemicals Co., Ltd.

TABLE 6

| Cover composition | | A |
|---|---|---|
| Formulation (party by mass) | Elastollan NY97A | 100 |
| | Titanium oxide | 4 |
| Slab hardness (Shore D) | | 47 |

For the cover, the following materials were used.

Elastollan NY97A: $H_{12}$MDI-polyether thermoplastic polyurethane elastomer available from BASF Japan The reinforcing layer is formed by applying a two-component curing type thermosetting resin to the molded intermediate layer. As the two-component curing type thermosetting resin, a paint composition (trade name "POLIN 750LE", available from SHINTO PAINT CO., LTD.) including a two-component curing type epoxy resin as a base polymer was used. The base material liquid of this paint composition includes 30 parts by mass of a bisphenol A type solid epoxy resin and 70 parts by mass of a solvent. The curing agent liquid of this paint composition includes 40 parts by mass of a modified polyamide amine, 5 parts by mass of titanium oxide, and 55 parts by mass of a solvent. The mass ratio of the base material liquid to the curing agent liquid is 1/1. This paint composition was applied to the surface of the intermediate layer with a spray gun, and maintained at 23° C. for 6 hours to obtain a reinforcing layer with a thickness of 10 μm.

(4) Molding of Half Shells

Compression molding of half shells were performed by, charging one pellet of the cover composition obtained as described above into each of depressed parts of lower molds for molding half shells, and applying pressure to mold half shells. Compression molding was performed at a temperature of 170° C. for 5 minutes under a molding pressure of 2.94 MPa.

(5) Molding of the Cover

The spherical body with the intermediate layer molded in (3) was covered with the two half shells obtained in (4) in a concentric manner, and the cover was molded by compression molding. Compression molding was performed at a temperature of 145° C. for 2 minutes under a molding pressure of 9.8 MPa.

Surface of the obtained golf ball body was subjected to a sandblast treatment, and marking, and then clear paint was applied thereto and dried in an oven at a temperature of 40° C. to obtain a golf ball having a diameter of 42.8 mm and a weight of 45.5 g. The performance of the obtained golf ball was evaluated, and results thereof are also shown in Tables 1 to 3.

From the results of Tables 1 to 3, the golf ball comprising a center, a cover and at least one intermediate layer disposed between the center and the cover, wherein the center is formed from a center composition having a flexural modulus ranging from 150 MPa to 450 MPa, a maximum loss factor (tan δ) between −20° C. and 0° C. of 0.08 or less, a rebound resilience of 55% or more, and a slab hardness ranging from 40 to 60 in Shore D hardness, and the center composition comprises, as a resin component, 30 mass % to 70 mass % of (A) a modified polyester elastomer having a Shore A hardness of 95 or less; 70 mass % to 30 mass % of (B) a binary ionomer resin having a Shore D hardness of 65 or more, a flexural modulus of 300 MPa or more, and a melt flow rate (190° C., 2.16 kg) of 1.0 g/10 min or more; and 0 mass % to 50 mass % of (C) a thermoplastic resin other than (A) component and (B) component (provided that a total content of (A) component, (B) component, and (C) component is 100 mass %) is excellent in resilience and has a high spin rate on approach shots.

The present invention is preferred for a golf ball comprising a center formed from a resin component. This application is based on Japanese Patent application No. 2011-222280 filed on Oct. 6, 2011, the contents of which are hereby incorporated by reference.

The invention claimed is:

1. A golf ball having a center, a cover, and at least one intermediate layer disposed between the center and the cover, wherein the center is formed from a center composition having a flexural modulus ranging from 150 MPa to 450 MPa, a maximum loss factor (tan δ) between −20° C. and 0° C. of 0.08 or less, a rebound resilience of 55% or more, and a slab hardness ranging from 40 to 60 in Shore D hardness, and the center composition comprises, as a resin component, 30 mass % to 70 mass % of (A) a modified polyester elastomer having a Shore A hardness of 95 or less;

70 mass % to 30 mass % of (B) a binary ionomer resin having a Shore D hardness of 65 or more, a flexural modulus of 300 MPa or more, and a melt flow rate (190° C., 2.16 kg) of 1.0 g/10 min or more; and 0 mass % to 50 mass % of (C) a thermoplastic resin other than said (A) component and (B) component (provided that a total content of the (A) component, (B) component, and (C) component is 100 mass %), wherein (A) the modified polyester elastomer is obtained by a reaction between 0.01 mass % to 30 mass % of (a-3) an unsaturated carboxylic acid or a derivative thereof and 100 mass % of (a-2) a polyester elastomer containing a polyalkylene glycol component in a content ranging from 5 mass % to 90 mass % in a presence of (a-1) a radical generator.

2. The golf ball according to claim 1, wherein a blending ratio of (a-1) component ranges from 0.001 mass % to 3 mass % with respect to 100 mass % of (a-2) component.

3. The golf ball according to claim 1, wherein a content of an acid component in (B) the binary ionomer resin is 15 mass % or more.

4. The golf ball according to claim 1, wherein the center composition comprises, as the resin component, 0.1 mass % to 50 mass % of (C) the thermoplastic resin, and wherein (C) component is at least one member selected from the group consisting of polyurethane, polyolefin, polyester, polyamide, polystyrene, polycarbonate, polyacetal, modified poly(phenyleneether), polyimide, polysulfone, polyethersulfone, poly(phenylenesulfide), polyarylate, polyamideimide, polyetherimide, polyetheretherketone, polyetherketone, polytetrafluroroethylene, polyaminobismaleimide, polybisamidetriazole, an acrylonitrile-butadiene-styrene copolymer, an acrylonitrile-styrene copolymer, and an acrylonitrile-EPDM-styrene copolymer.

5. The golf ball according to claim 1, wherein the center composition contains at least one filler selected from the group consisting of gold, tungsten, lead, copper, iron, cast iron, pig iron, zinc, titanium, aluminum, zirconium, aluminum oxide, bismuth oxide, cerium oxide, copper oxide, tin oxide, titanium oxide, yttrium oxide, zinc oxide, silica, barium sulfate, calcium carbonate, talc, montmorillonite, and mica in an amount ranging from 1 part to 40 parts by mass with respect to 100 parts by mass of the resin component.

6. The golf ball according to claim 1, wherein the center composition has a melt flow rate (230° C., 2.16 kg) in a range from 3 g/10 min to 30 g/10 min.

7. The golf ball according to claim 1, wherein the center has a diameter of 5.0 mm or more and 40 mm or less.

8. The golf ball according to claim 1, wherein the center has a density in a range from 0.80 g/cm$^3$ to 1.5 g/cm$^3$.

9. The golf ball according to claim 1, wherein the intermediate layer directly covering the center is formed from a rubber composition.

10. The golf ball according to claim 1, wherein the intermediate layer comprises an envelope layer directly covering the center and having a slab in a range from 40 to 90 in JIS-C hardness and at least one intermediate layer covering the envelope layer.

11. The golf ball according to claim 10, wherein the envelope layer has a thickness in a range from 2.0 mm to 25 mm.

12. The golf ball according to claim 10, wherein a spherical core consisting of the center and the envelope layer covering the center has a diameter in a range from 7 mm to 41.0 mm.

13. The golf ball according to claim 12, wherein the spherical core has a surface hardness in a range from 40 to 95 in JIS-C hardness.

14. The golf ball according to claim 10, wherein the intermediate layer covering the envelope layer has a slab hardness in a range from 40 to 70 in Shore D hardness.

15. The golf ball according to claim 1, wherein the cover has a thickness in a range from 0.3 mm to 2.5 mm.

16. The golf ball according to claim 1, wherein the cover has a slab hardness in a range from 20 to 70 in Shore D hardness.

* * * * *